US006243967B1

(12) United States Patent
Dovolas

(10) Patent No.: US 6,243,967 B1
(45) Date of Patent: Jun. 12, 2001

(54) BAG DRYER

(76) Inventor: Dean J. Dovolas, 4445 Chowen Ave. South, Minneapolis, MN (US) 55410

( * ) Notice: Subject to any disclaimer, the term of this patent is extended or adjusted under 35 U.S.C. 154(b) by 0 days.

(21) Appl. No.: 09/524,345

(22) Filed: Mar. 13, 2000

(51) Int. Cl.[7] ..... F26B 25/00

(52) U.S. Cl. ..... 34/103; 34/106; 34/239; 248/95; 211/13.1

(58) Field of Search ..... 34/102, 103, 104, 34/105, 106, 107, 239, 240; 248/95, 97, 98, 99; 211/13.1, 189, 200; 32/58, 59

(56) References Cited

U.S. PATENT DOCUMENTS

| | | | | |
|---|---|---|---|---|
| 1,086,002 | | 2/1914 | Stewart . | |
| 2,908,463 | | 10/1959 | Chenette . | |
| 3,476,341 | | 11/1969 | Patterson . | |
| 3,561,077 | | 2/1971 | Grant . | |
| 3,905,406 | | 9/1975 | Cruse . | |
| 4,332,361 | | 6/1982 | McClellan . | |
| 4,689,897 | * | 9/1987 | Marsalona | 34/103 |
| 4,735,340 | | 4/1988 | Preston . | |
| 5,080,237 | | 1/1992 | Hefner . | |
| 5,102,076 | | 4/1992 | North et al. . | |
| 5,188,244 | | 2/1993 | Hollstegge . | |
| 5,247,752 | | 9/1993 | Gyr et al. . | |
| 5,405,018 | | 4/1995 | Anthrop, Jr. . | |
| 5,421,542 | | 6/1995 | Crutcher . | |
| 5,524,358 | * | 6/1996 | Matz | 34/235 X |
| 5,641,137 | | 6/1997 | Collier . | |
| 5,875,563 | * | 3/1999 | Snow | 34/103 |
| 5,943,786 | * | 8/1999 | Stahley | 34/106 |
| 5,971,303 | * | 10/1999 | Pugh-Gottlieb | 46/46.013 |

* cited by examiner

*Primary Examiner*—Stephen Gravini
(74) *Attorney, Agent, or Firm*—Roger W. Jensen

(57) ABSTRACT

A bag dryer comprising a pair of identical members, each having a central portion, and integral faucet-engaging portion, and an integral bag-engaging portion. The two members are pivotally connected and spring-biased so that the faucet-engaging portions tend to be rotated toward one another. The dryer is intended to be mounted upon a faucet over a sink so that dripping from a bag inverted over the bag-engaging portions may drip into the sink.

9 Claims, 4 Drawing Sheets

(ALTERNATE)

BAG DRYER

BACKGROUND OF THE INVENTION

1. Field of the Invention

The present invention relates to the field of bag dryers, with particular focus on a device for drying all sizes of plastic food storage bags of the type in widespread use.

2. Description of the Prior Art

There are a significant number of prior art bag dryers; one example being U.S. Pat. No. 5,641,137 which discloses a bag dryer including a plurality of elongated dowels projecting from a pair of rectangular base portions. Other examples include U.S. Pat. No. 5,080,237, disclosing a holder with segmented arms pivotally joined. U.S. Pat. No. 5,121,842 shows a capped-tree apparatus. U.S. Pat. No. 5,303,827 discloses a plastic bag drying rack having a tree-like configuration. A dryer rack for freezer bags and similar articles is disclosed in U.S. Pat. No. 5,188,244. All prior art arrangements known to Applicant suffer from either being costly to manufacture and/or have other disadvantages associated with their use and storage.

It is an object of the present invention to provide a new and improved bag dryer which has advantages over the prior art bag dryers.

SUMMARY OF THE INVENTION

The present invention, in simple terms, is adapted to be clamped on the horizontal portion of a spigot or spout member of a faucet associated with a sink, with the dryer structure providing a support for an inverted plastic bag, the bags having been washed or rinsed out with water and requiring drying. More specifically, the bag dryer of this invention comprises first and second substantially identical members, each being fabricated from flat, thin material. Each member has a relatively narrow longitudinally-extended central portion having top and bottom ends. A faucet or spout-engaging portion is connected to the bottom end, and a bag-engaging portion is connected to the top end of the central portion. Each central portion has at least one bracket tab extending normal or transverse to the longitudinal axis thereof The two members are pivotally assembled together in matching facing relationship by pivot means connected to said bracket tabs, to thus define a pivotal axis. Further, the two members are biased by spring means so as to be rotated about the pivotal axis so that the faucet-engaging portions thereof tend to be rotated toward one another. In the preferred embodiment of the invention, the faucet engaging portions are curved to facilitate the engagement of a spigot or faucet. Further, the bag engaging portions of the dryer are preferably characterized by having a longitudinal extent at least as long as the combined longitudinal extent of the central and faucet-engaging portions, and are further characterized preferably by having a substantial transverse extent with both sides tapered to connect with the top ends of the central portions. Another feature of the preferred embodiment is to have the bag-engaging portions longitudinally curved so as to define opposed concave surfaces.

A modification of the preferred embodiment provides, for each bag-engaging portion, at least one aperture therethrough so as to reduce the weight of the device, and to accelerate the drying process.

DETAILED DESCRIPTION OF THE PREFERRED EMBODIMENT

Figure 3:
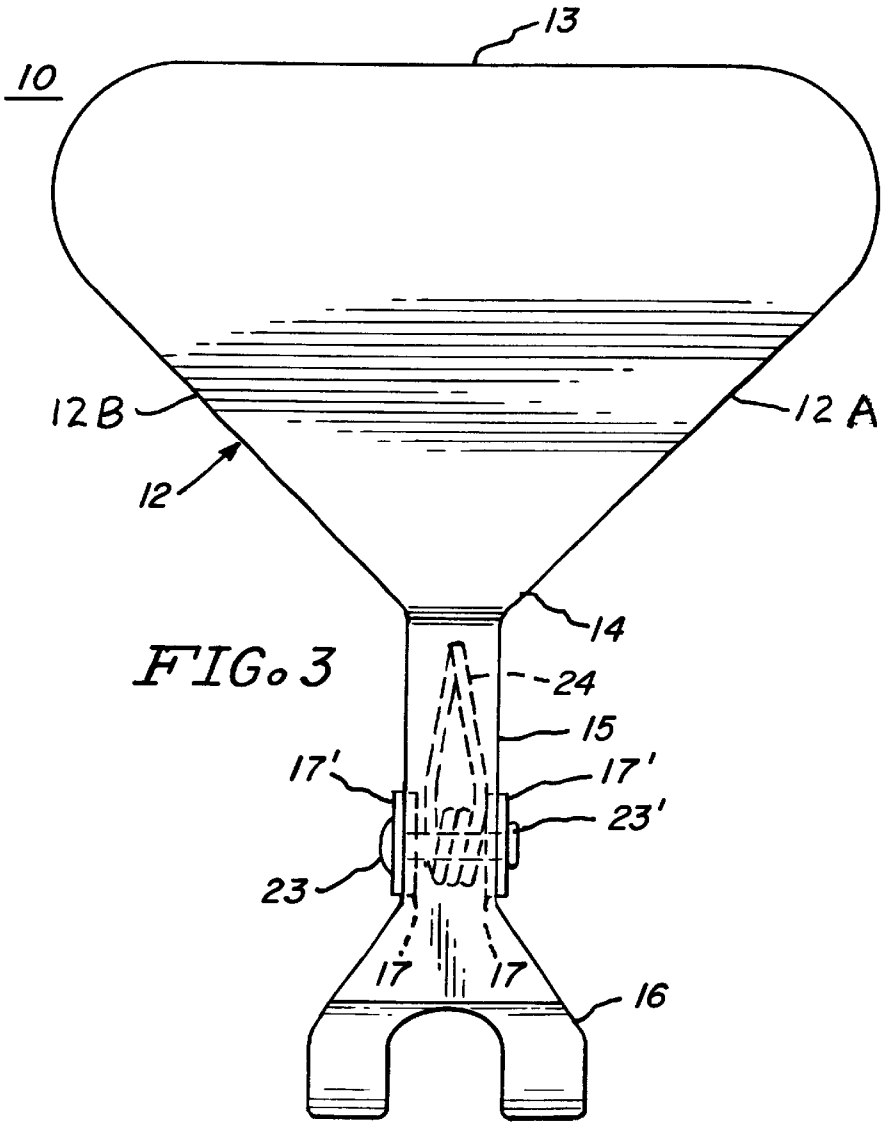
FIG. 3 is a view of the bag dryer of FIG. 2 as viewed along section lines 3—3.
Figure 2:
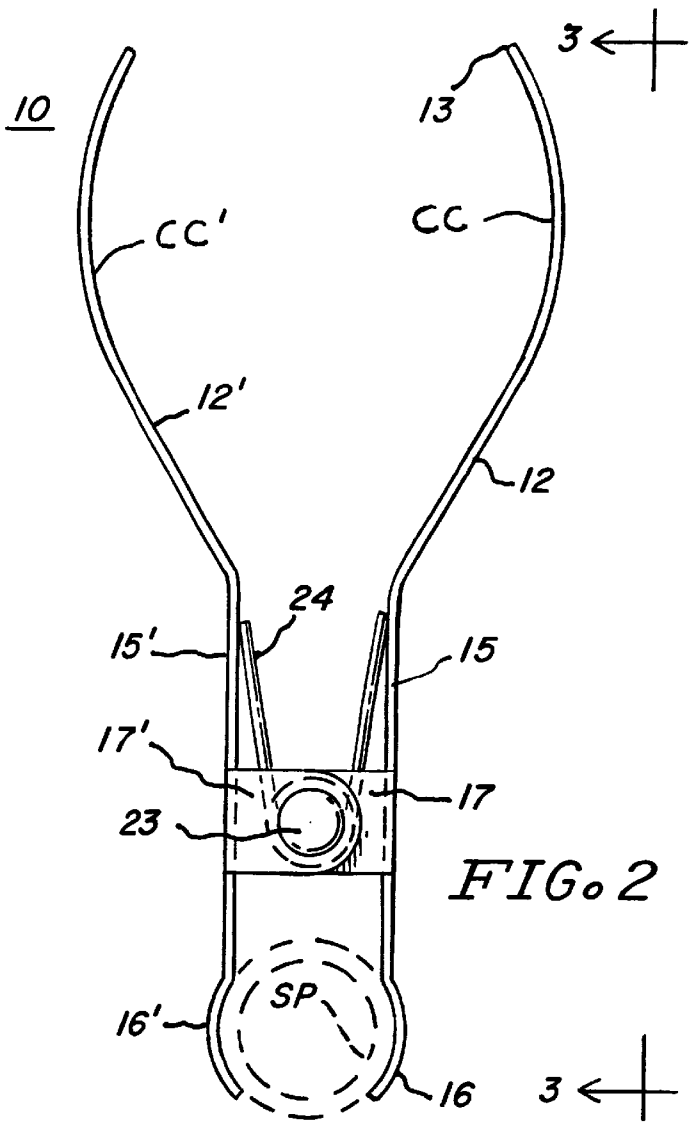
FIG. 2 is a left side view of the bag dryer 10, with the bag AA being removed from this view.

Referring to FIGS. 2 and 3, a bag dryer 10 comprises first and second substantially identical members 12 and 12', each of which may be fabricated from relatively flat material such as steel or plastic. Each of members 12 and 12' has a relatively narrow longitudinally elongated central portion 15 and 15' respectively, and each central portion has top and bottom ends as depicted in FIG. 2. Faucet or spout-engaging portions 16 and 16' are integrally connected, respectively, to the bottom ends of the central portions 15 and 15', and these preferably have a curved shape as shown, so as to facilitate the efficient gripping of the outside surface of the spigot or faucet SP. A bag-engaging portion 12 is integrally connected to the top end of central portion 15, as is clearly shown in FIGS. 2 and 3. In the preferred embodiment, bag-engaging portion 12 has a longitudinal extent as least as long as the combined longitudinal extent of the central and faucet-engaging portions 15 and 16; further, portion 12 has a substantial transverse extent designated by reference numeral 13, with side edges 12A and 12B tapered to connect with the top end of central portion 15 as is clearly shown in FIG. 3. Additionally, bag-engaging portion 12 is longitudinally curved to form an inwardly facing or concave surface CC as is shown in FIG. 2.

Each of the members 12 and 12' have a pair of bracket tabs integrally connected with said central portions, and extending normal or transverse thereto, the tabs for member 12 being identified by reference numeral 17, and the tabs for member 12' being identified by reference numeral 17'. As is clearly shown in FIGS. 2 and 3, the tabs 17 and 17' are nested together and, together with a suitable rivet-like member 23 (which extends through suitable apertures in 17 and 17' and is riveted at 23'), function to provide a pivotal axis for permitting the members 12 and 12' to be rotated with respect to one another. A spring means 24 is positioned around rivet 23, and the two ends thereof, as shown in FIG. 2, tend to bias the upper ends of members 12 and 12' away from one another. Stated otherwise, the spring means 24 tends to bias the lower ends 16 and 16', as shown in FIG. 2, toward one another so as to provide a gripping action on the spigot or faucet SP.

As mentioned, the first and second members 12 and 12' are substantially identical so that, when assembled as shown in FIGS. 2 and 3, the concave surfaces CC and CC', for members 12 and 12', respectively, are opposed or facing one another.

Figure 1:
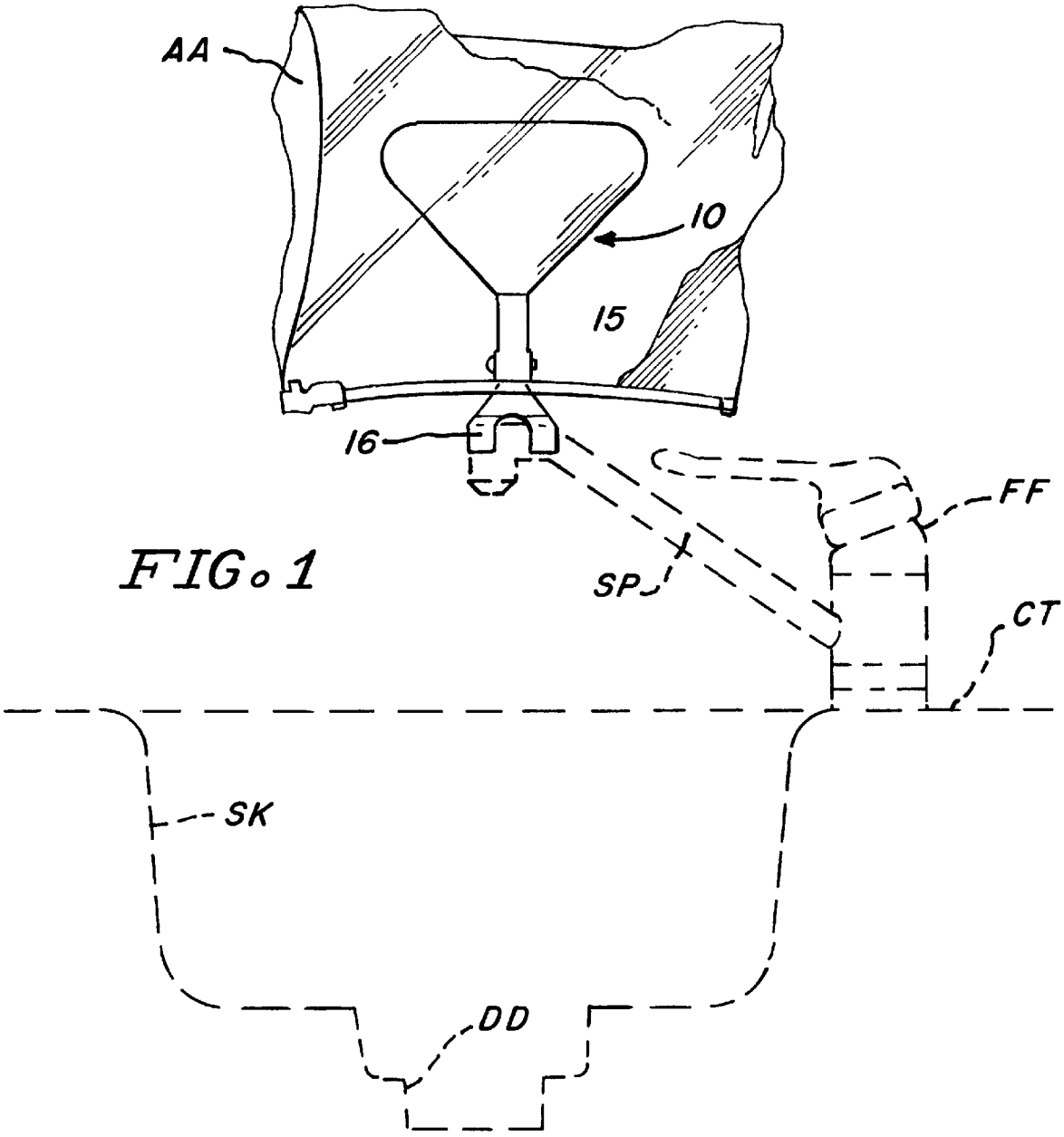
FIG. 1 is a view of a bag dryer 10 in accordance with the present invention, clamped on a spout or spigot or faucet SP and supporting a plastic bag AA inverted over a sink SK.

In operation, the bag dryer is used as is depicted in FIG. 1 wherein the faucet-engaging portions 16 and 16' of member 12 engage or grip the spigot or faucet SP, the spigot of course being connected to a valve means having an operator FF projecting up above a countertop CT in which is disposed sink SK having a drain DD. The plastic bag to be dried is inverted over the bag dryer 10, with the two bag-engaging portions 12 and 12' being spaced apart a preselected amount so as to facilitate an efficient air drying of the bag. It will be noted that any water or other material dripping or falling from the bag AA will fall into the sink SK, thus minimizing any messing of the countertop area.

Figure 5:
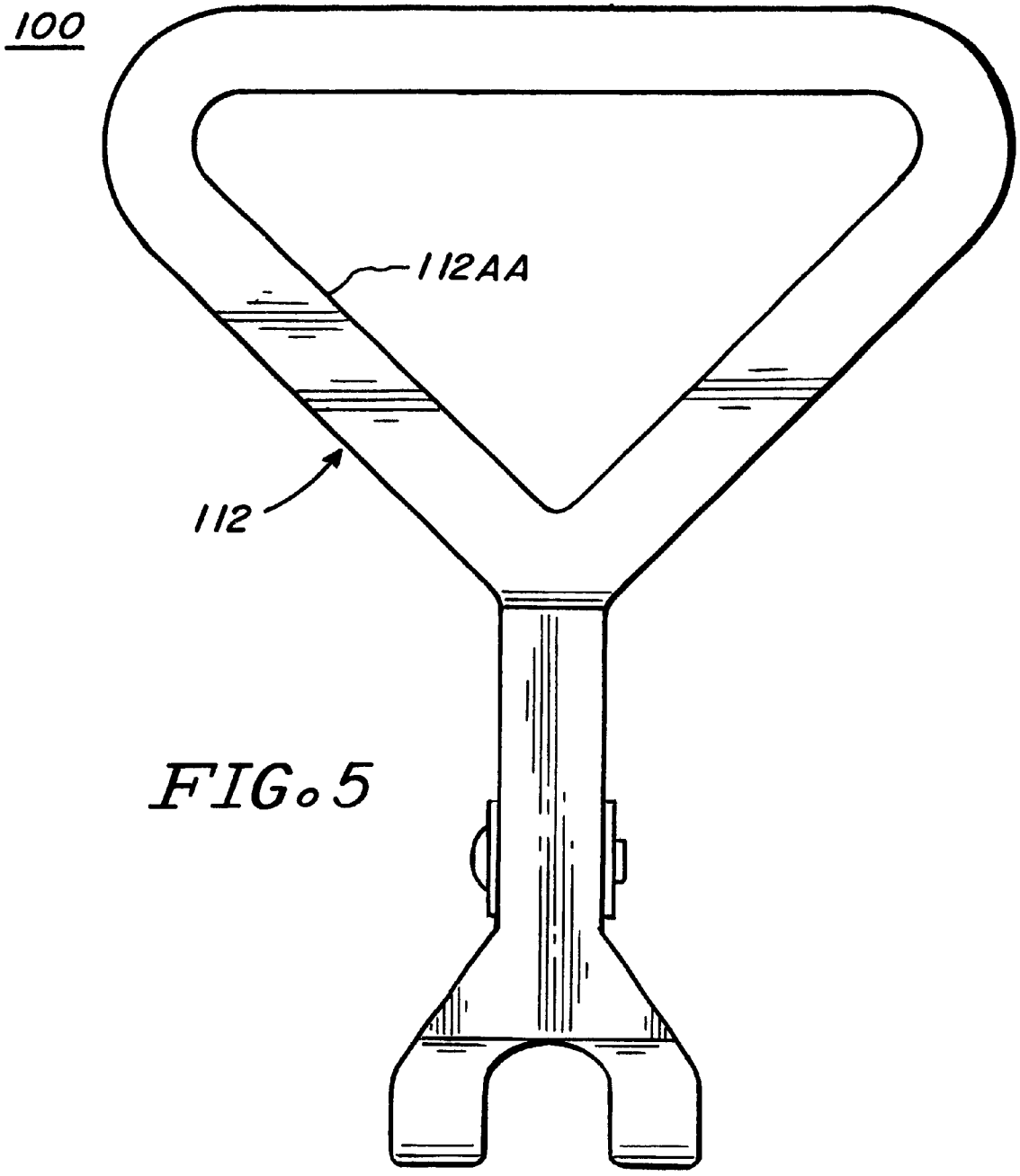
FIG. 5 is a plan view of another modification of the invention.

The modification shown in FIG. 5 provides a bag dryer very similar to that depicted in FIGS. 1–3, except that the bag-engaging portion 112 has a large aperture 112AA therethrough, the shape of the aperture being generally similar to the outside configuration of the member 112, but with reduced dimensions. Thus, as shown in FIG. 5, the aperture 112AA has a somewhat triangular shape. This arrangement has been found to be advantageous in that it uses less material in manufacture, has a reduced weight and cost of manufacture, and accelerates the drying process.

Figure 4:
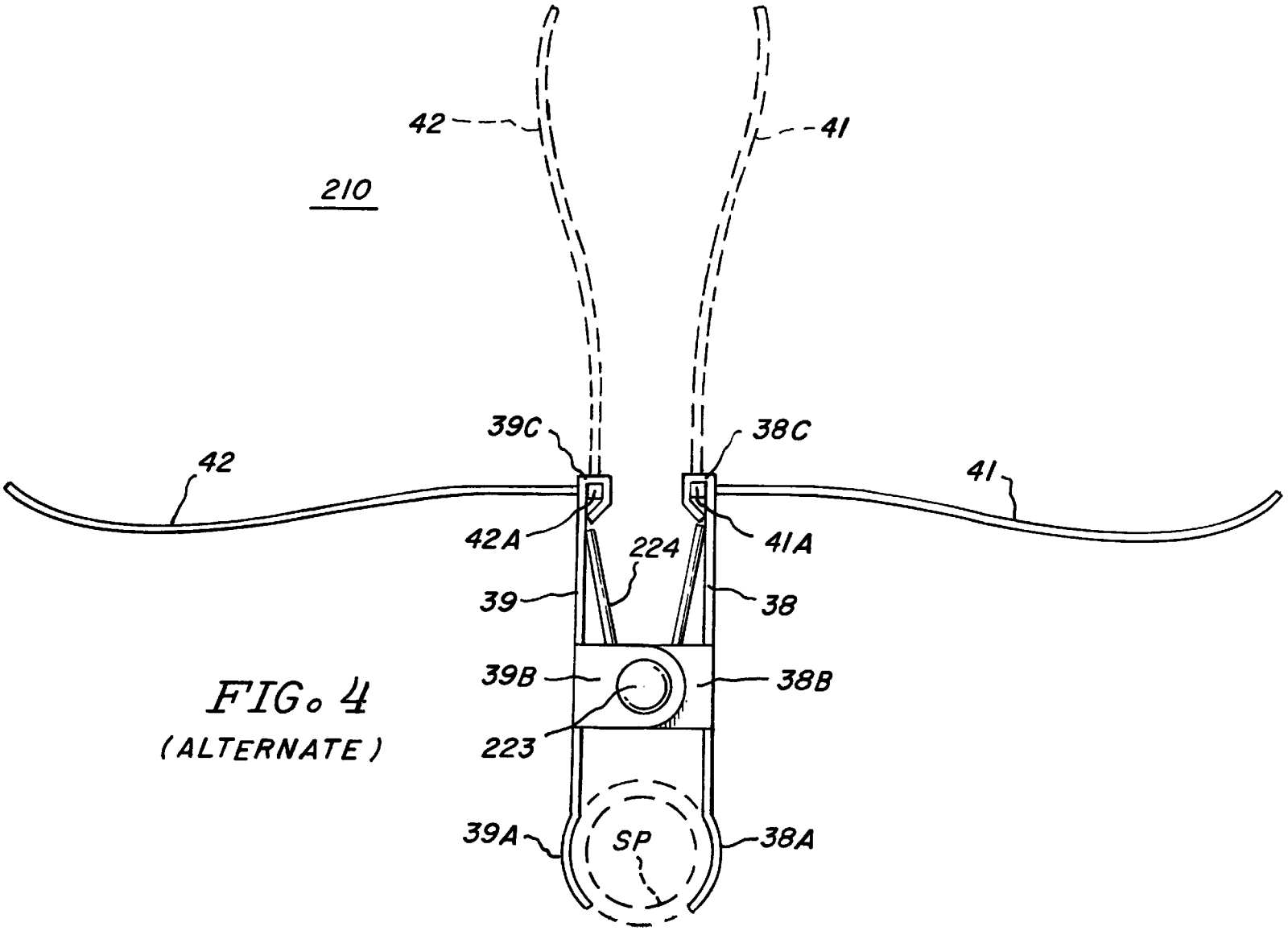
FIG. 4 is a left side view of an alternate configuration of the invention.

The alternate apparatus shown in FIG. 4 is a modification of the invention shown in FIGS. 1–3, wherein the bag engaging portions are no longer integrally connected to the central portions. To the contrary, the device shown in FIG. 4 has two relatively narrow longitudinally elongated central portions 38 and 39, having top and bottom ends. At the bottom ends, respectively, are faucet-engaging portions 38A and 39A. Inwardly extending tabs 38B and 39B for portions 38 and 39 respectively are similar to tabs 17 and 17' of the device shown in FIGS. 2 and 3, and a rivet-like member 223 provides a means for pivotal rotation. Further, a spring 224 tends to bias ends 38A and 39A toward one another. At the top ends of 38 and 39 are small housing-like members 38C and 39C for receiving the ends 41A and 42A of separate bag-engaging members 41 and 42. The pivotal connections between members 41 and 42 and their respective pivotal supports 38C and 39C permit the members 41 and 42 to be positioned in one of several positions. The solid line depiction of 41 and 42 in FIG. 4 shows these members to be oriented substantially horizontal with respect to the longitudinal axes of the members 38 and 39. An alternate position for members 41 and 42 is shown by the dotted-line designation in FIG. 4, and the members 41 and 42 may also be positioned in intermediate positions.

As indicated, the bag dryer may be made out of any suitable materials such as plastic, steel, aluminum, etc. The separate members 12 and 12' as indicated, are essentially identical and thus may be made from a metal stamping process. It may be desirable to coat the inside or gripping surfaces of portions 16 and 16' with a non-abrasive material, e.g., a rubber-like compound, so as to prevent any marring or scratching of the spigot or faucet SP.

While the preferred embodiment of the invention has been illustrated, it will be understood that variations may be made by those skilled in the art without departing from the inventive concept. Accordingly, the invention is to be limited only by the scope of the following claims.

I claim:

1. A bag dryer comprising:

first and second substantially identical members, each of said members being fabricated from relatively thin material and having:

i) a relatively narrow, longitudinally-elongated central portion having top and bottom ends;

ii) a faucet-engaging portion connected to said bottom end of said central portion;

iii) a bag-engaging portion connected to said top end of said central portion; and iv) at least one bracket tab connected to said central portion and extending normal thereto;

said members (a) being pivotally assembled together in matching facing relationship by pivot means connected to said bracket tabs and defining a pivotal axis, and (b) being biased by spring means to be rotated about said pivotal axis so that said faucet-engaging portions tend to be rotated toward one another.

2. The bag dryer of claim 1 wherein said faucet-engaging portions are curved to match, approximately, the exterior surface of a faucet.

3. The bag dryer of claim 1 wherein said bag-engaging portions have a longitudinal extent at least as long as the combined longitudinal extent of said central and faucet-engaging portions.

4. The bag dryer of claim 3 wherein said bag-engaging portions also have a substantial transverse extent, with side edges tapered to connect with the top ends of said central portions.

5. The bag dryer of claim 4 wherein said bag-engaging portions each have at least one aperture therethrough.

6. The bag dryer of claim 5 wherein said apertures follow and are spaced a preselected distance from the periphery of said bag-engaging portions.

7. The bag dryer of claim 4 wherein said bag engaging portions are longitudinally curved to define opposed concave surfaces.

8. The bag dryer of claim 1 wherein said bag-engaging portions are each pivotally connected, respectively, to said top ends of said central portions of said first and second members.

9. The bag dryer of claim 1 wherein said bag-engaging portions are integral with, respectively, said top ends of said central portions of said first and second members.

* * * * *